US007254843B2

(12) United States Patent
Talluri

(10) Patent No.: US 7,254,843 B2
(45) Date of Patent: Aug. 14, 2007

(54) IMPACT ABSORBING, MODULAR HELMET

(76) Inventor: Srikrishna Talluri, 27136 Gateway Dr. South, Apt. #304, Farmington Hills, MI (US) 48334

( * ) Notice: Subject to any disclaimer, the term of this patent is extended or adjusted under 35 U.S.C. 154(b) by 0 days.

(21) Appl. No.: 11/477,769

(22) Filed: Jun. 29, 2006

(65) Prior Publication Data

US 2006/0242752 A1 Nov. 2, 2006

Related U.S. Application Data

(63) Continuation-in-part of application No. 10/881,068, filed on Jun. 30, 2004, now Pat. No. 7,089,602.

(60) Provisional application No. 60/483,858, filed on Jun. 30, 2003.

(51) Int. Cl.
*A42B 1/22* (2006.01)

(52) U.S. Cl. ..... 2/411

(58) Field of Classification Search ..... 2/411, 2/412, 413, 414, 425, 422, DIG. 3
See application file for complete search history.

(56) References Cited

U.S. PATENT DOCUMENTS

| | | | | |
|---|---|---|---|---|
| 2,381,524 | A * | 8/1945 | Taylor | 2/7 |
| 3,174,155 | A * | 3/1965 | Pitman | 2/411 |
| 3,242,500 | A * | 3/1966 | Derr | 2/412 |
| 3,501,772 | A * | 3/1970 | Wyckoff | 2/421 |
| 3,787,893 | A * | 1/1974 | Larcher | 2/413 |
| 3,872,511 | A * | 3/1975 | Nichols | 2/413 |
| 3,906,546 | A * | 9/1975 | Gooding | 2/414 |
| 4,075,717 | A * | 2/1978 | Lemelson | 2/412 |
| 4,124,904 | A * | 11/1978 | Matthes | 2/413 |
| 4,307,471 | A * | 12/1981 | Lovell | 2/411 |
| 4,937,888 | A * | 7/1990 | Straus | 2/411 |
| 5,150,479 | A * | 9/1992 | Oleson | 2/414 |
| 5,177,815 | A * | 1/1993 | Andujar | 2/411 |
| 5,815,846 | A * | 10/1998 | Calonge | 2/413 |
| 6,282,724 | B1 * | 9/2001 | Abraham et al. | 2/412 |
| 7,089,602 | B2 * | 8/2006 | Talluri | 2/411 |
| 2001/0032351 | A1 * | 10/2001 | Nakayama et al. | 2/412 |

FOREIGN PATENT DOCUMENTS

| | | | |
|---|---|---|---|
| DE | 3314924 | A1 * | 9/1984 |
| DE | 3607583 | A1 * | 9/1987 |
| WO | WO 9400031 | A1 * | 1/1994 |
| WO | WO 9614768 | A1 * | 5/1996 |

* cited by examiner

*Primary Examiner*—Rodney M. Lindsey

(57) ABSTRACT

An impact absorbing, modular helmet that uses impact absorbing layers outside the hard casing of the helmet to prevent and/or reduce injury to the user is described. The protective layers on the outer side of the hard casing increase the time of impact and thereby reduces the intensity of the impact forces to reduce their injury potential. The outermost layer would preferably be made of lightweight yet rigid, durable material made of polymers, composites or metal alloys with a low friction coefficient. Subsequent layers may be made up of a polymer honeycombed structure and a uniformly consistent impact absorbing polymer material. These impact-absorbing layers may also be made and used as an independent, detachable, external protective cover that may be attached universally over hard casing helmets.

20 Claims, 6 Drawing Sheets

IMPACT ABSORBING, MODULAR HELMET

CROSS-REFERENCE TO RELATED APPLICATIONS

The present application is a continuation-in-part of application Ser. No. 10/881,068, filed on Jun. 30, 2004, now U.S. Pat. No. 7,089,602 which claims priority from provisional application Ser. No. 60/483,858 filed Jun. 30, 2003, the subject matter of all of which are hereby incorporated by reference.

BACKGROUND OF THE INVENTION

This invention relates generally to protective headgear and, more specifically, to an impact absorbing, modular helmet that prevents injury and reduces damage to the user.

Protective headgear or helmets have been worn for a long time now, by individuals to protect against head injuries. The use of helmets is often a mandatory requirement for driving bicycles and certain other motor vehicles, in high impact sports and in material handling and other potentially hazardous locations.

The use of safety helmets has been just that—to reduce or completely protect the user from any top, lateral and penetration impact to the user's head. However, commonly used protective headgears use a hard outer casing with an impact-energy absorbing padding placed between the outer casing and the user's head. The flaw in these hard casing helmets is that they actually permit the generation of a high-impact shock wave and only after this shock wave is generated are they designed to minimize the strength of the shock wave and reduce its effects by the use of shock absorbing material between the hard casing and the user's head. If a rider wearing such a typical helmet falls off from a bicycle or a motorbike (to the side) and hits the surface hard with the helmet, the impact of the hard shell meeting the hard surface generates a shockwave and a high impact force, which is then absorbed (as best as possible) by the inner shock-absorbing material inside the hard casing and in contact with the rider's head. The impact force is often so great that the rider's helmet may even initially bounce back upon contacting the surface and the head may be yanked back subjecting the head and neck regions to additional injury causing forces. If the impact is high enough, it may lead to a concussion (striking of the brain matter to the skull with moderate force) or even a contusion (striking of the brain matter to the skull with high force) and may also lead to skull fracture.

Published research suggests that the human skull can fracture at decelerations as low as 225 G's and that concussions can occur at substantially lower decelerations. Research has shown that to offer maximum protection to the head, the rate of deceleration should be as low as possible.

Further, mandatory rules by industry organizations and/or government regulations often obligate the work force of specific industries such as the construction industry to wear 'hard hats', which again carry the limitations mentioned above—that of permitting the initial generation of a shock wave and ensuing attempts by shock absorbing padding in the headgear to absorb the said impact forces that cause this shockwave.

Hence, it is the object of the present invention to overcome the abovementioned problems and create a novel and improved, versatile, impact absorbing protective helmet.

BRIEF SUMMARY OF THE INVENTION

Accordingly, it is an object of the present invention to provide a helmet that reduces the shockwave generation at the first instance itself, by increasing the time of impact and thereby reducing the deceleration rate of the impact forces acting on the user's helmet.

It is another object of the present invention to provide a multi-layered helmet that prevents damage by lowering the rate of deceleration of the user's head.

It is yet another object of the present invention to provide a multi-layered helmet with at least one impact-energy absorbing outer casing.

It is still yet another object of the present invention to provide a protective high impact-energy absorbing layer that can be used universally over hard casing helmets.

It is still yet another object of the present invention to provide a protective helmet that can be manufactured economically.

DETAILED DESCRIPTION OF THE INVENTION

The present invention incorporates plural high impact-energy absorbing outer layers secured to the rigid shell of a protective helmet. The helmet further has at least one energy absorbent material between the hard casing and the user's head.

Figure 1A:
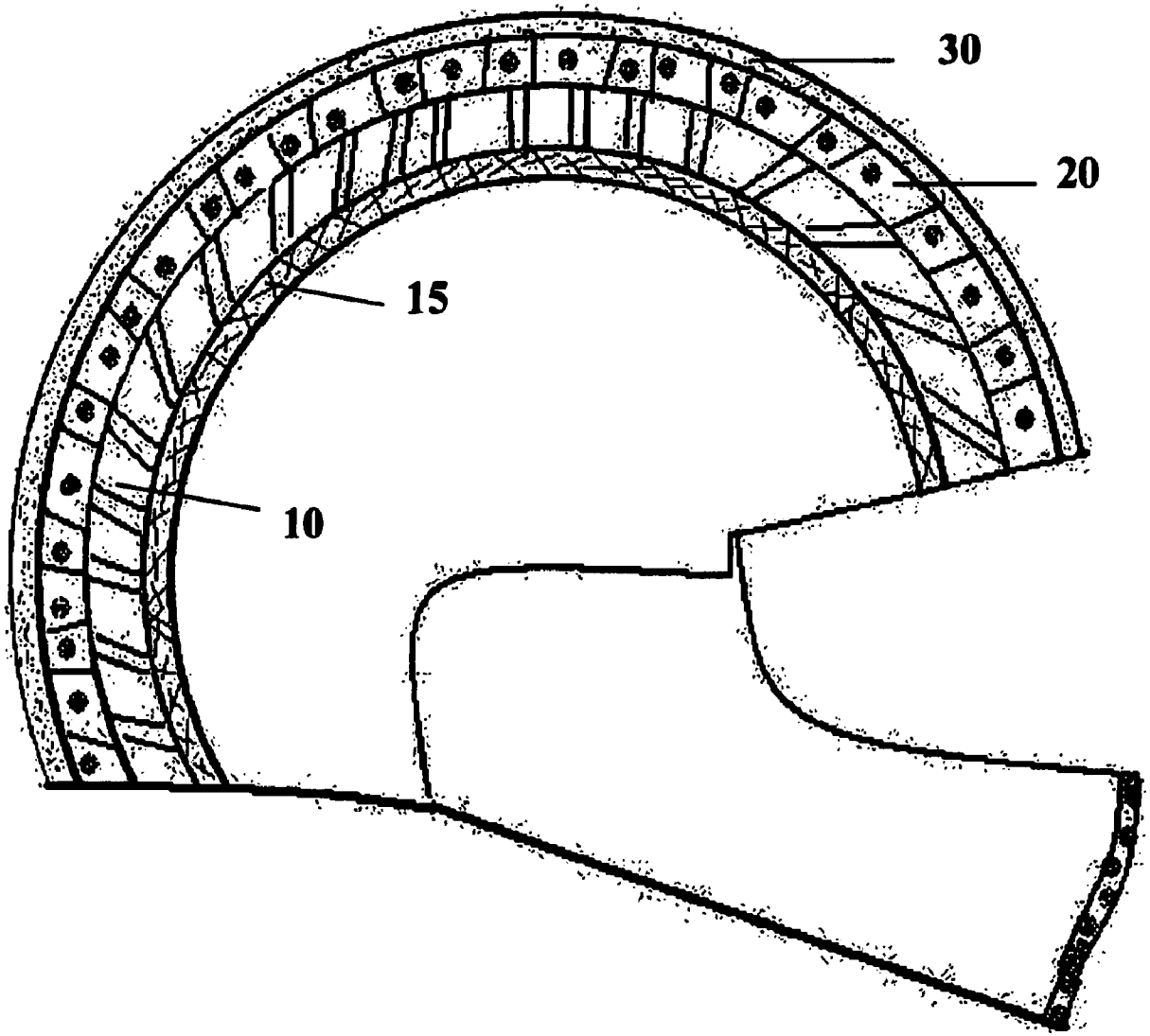
FIGS. 1A and 1B depict two views of a helmet with two protective layers on the outer side of the hard casing, one of them being a honeycombed, impact-absorbing polymeric layer.

The preferred embodiment of the present invention (FIGS. 1A and 1B) consists of two layers over the hard casing 10. The outermost layer 30 is made up of a light-weight yet rigid, durable polymeric material with the unique quality of minimal sliding friction. The reason for this material having a low friction coefficient is that the helmet is supposed to slide along, i.e. move the head of the user along with the rest of the body. Researchers have remarked that while the helmet should protect the user's head for impact forces, the helmet (when in contact with the ground) should not impede or resist the movement of the head as compared to the rest of the body, which might be carrying or moving forward with a good momentum when the user has fallen off a moving vehicle. Such a restriction to the movement of the user's head vis-à-vis the user's body had shown detrimental results with damages to the neck and head region of the user—as the body would be moving with a higher momentum and if the head's momentum is slowed by the helmet it would induce severe stress on the neck region. As such the outer layer 30 would be made of a material that would protect the user's head from the impact forces yet have a very low friction coefficient with potential contact surfaces.

Figure 1B:
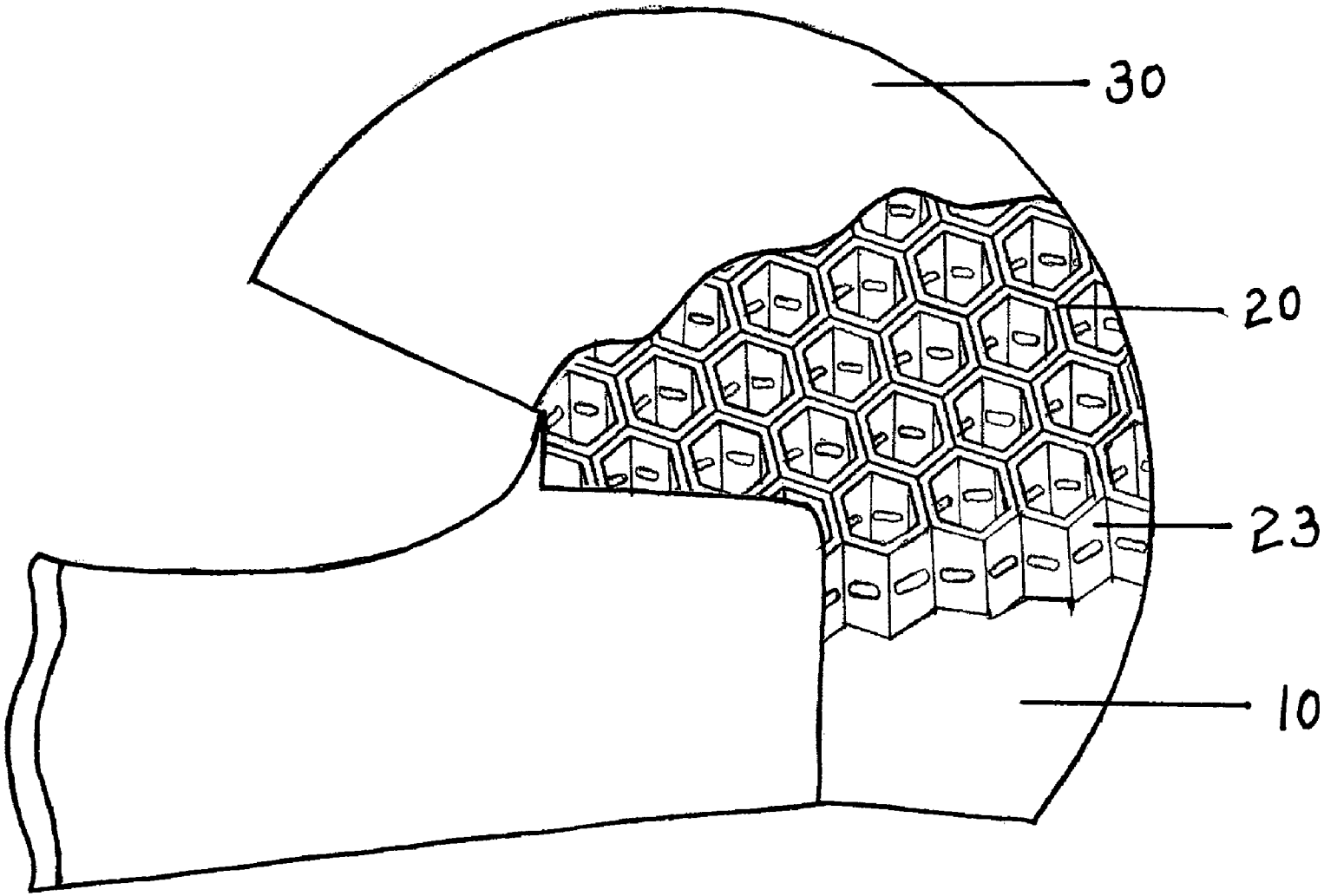
Figure 2A:
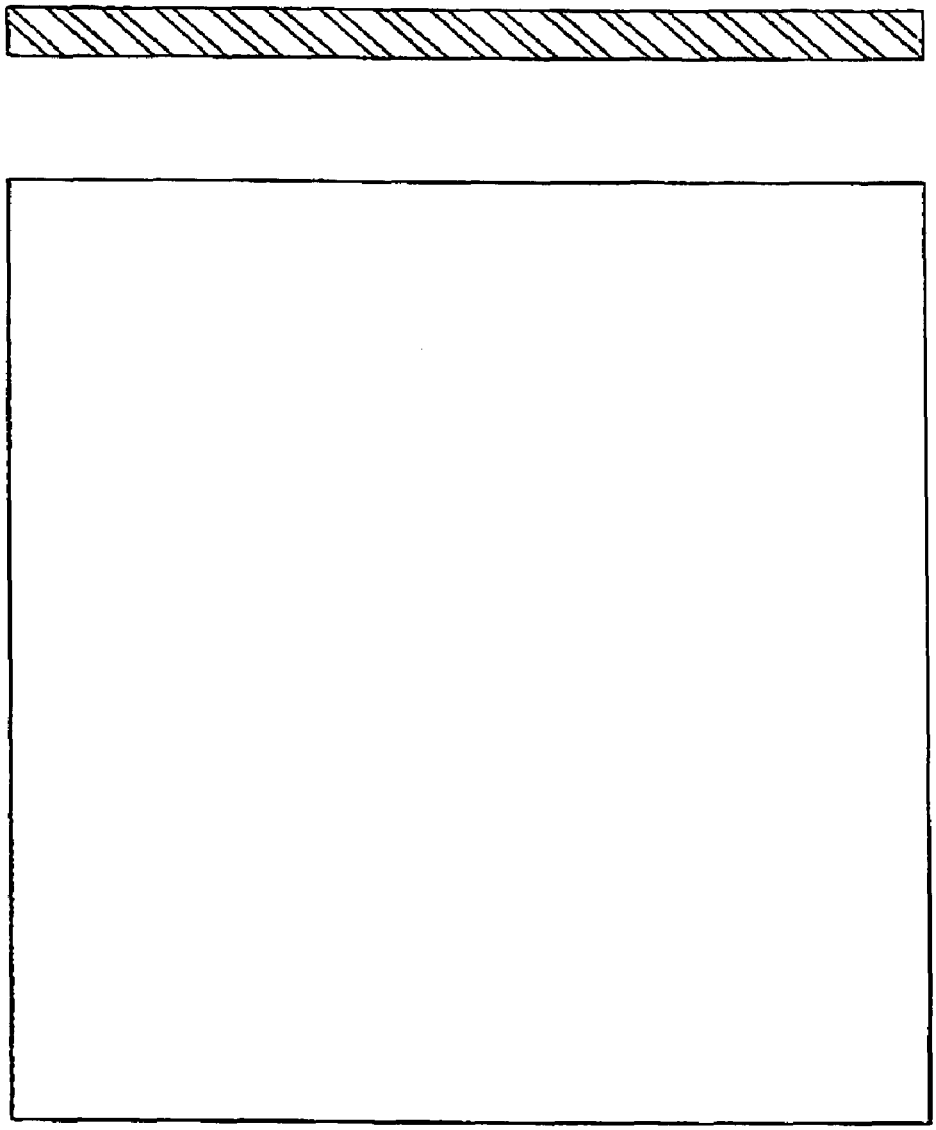
FIGS. 2A and 2B independently show the top view (plan) and side view of each of the two layers that would go over the hard casing of a typical helmet.
Figure 2B:
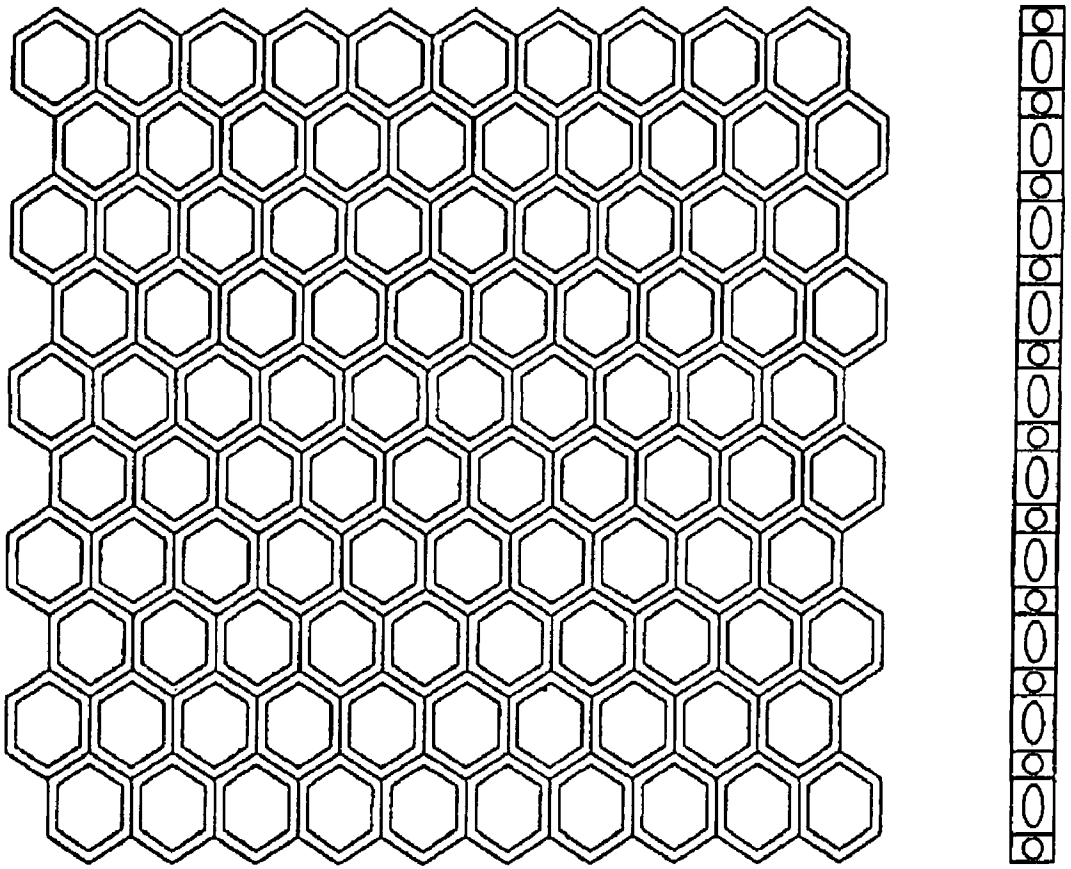
Figure 3:
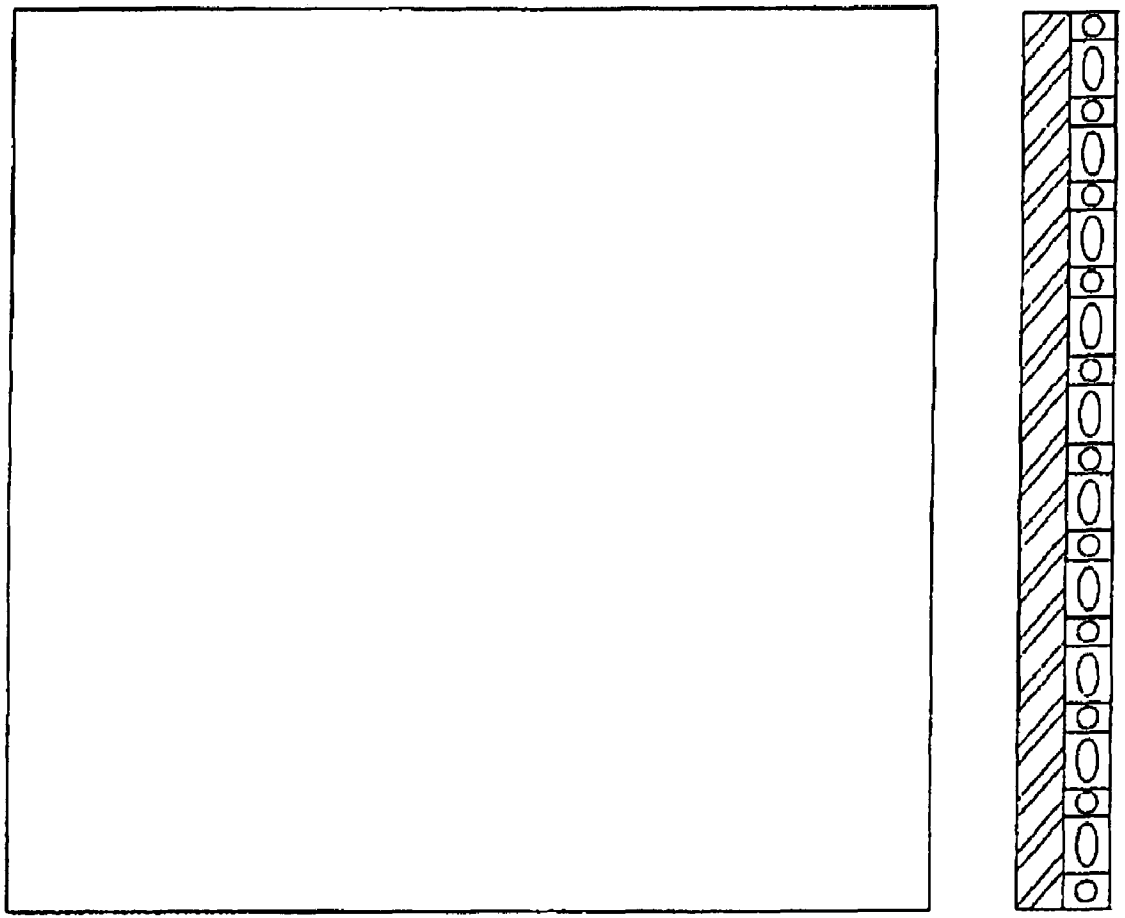
FIG. 3 shows the top view (plan) and side view of the two layers of FIG. 1, as they would be used in practice.

This outer layer is firmly attached to the next energy-absorbing layer 20, which is a honeycombed structure with hollow hexagonal cells. It should be noted that the walls of these hexagonal cells are perforated with oval or circular shaped holes so that when a particular hexagonal cell is compressed by an external impact, the air in this cell may pass through the holes in the walls to adjacent cells. The energy absorbing layer in typical helmets, which exists between the rigid shell and the user's head, is shown by 15 in FIG. 1A. FIG. 1B is another view showing the two layers 20 and 30 on top of the hard casing 10. The walls of the energy-absorbing hexagonal layer 20 (with oval perforations) are shown by 23. The top view (plan) and side view of layers 20 and 30 are shown independently in FIGS. 2B and 2A, respectively. FIG. 3 shows a combination of these two layers in the sequence they would be attached onto the hard casing of a helmet as described in this embodiment. The side view of FIG. 3 distinctly shows the layers that would be used over the hard casing of the helmet.

When the rider of a bike wearing such a helmet falls off the vehicle and the helmet impacts the ground surface, the outer layer 30 undergoes elastic deformation and compresses the honeycombed layer 20 below it. The air within the cells of this honeycombed layer, which have been compressed by the outer layer are then pushed out through the holes in the walls of the honeycombed layer into adjacent cells and during this process both the walls and the air within the honeycombed layer gradually resist the impact of the force on the helmet, thereby increasing the time of contact (or the duration of impact) before passing on the impact force to the hard casing of the helmet. As the impact force is inversely proportional to the square of the time of impact, this resistance by the outer layer 30 and the honeycombed layer 20 reduces the impact forces acting on the helmet.

When the impact force is no longer in effect, such as when the helmet is no longer in contact with the ground or other object, the elastic nature of the walls of the hexagonal cells of the honeycombed layer 20 comes into play and the walls regain their original shape. During this process of the compressed walls (of the hexagonal cells that bore the impact) regaining their original shape, air is automatically sucked in from the adjacent cells through the holes in the walls until equilibrium is reached. Similarly, the elastic nature of the outer layer 30 makes the layer retain its original shape. The outer layer 30 may also be chosen of material that would move radially inward while remaining completely rigid, instead of undergoing elastic deformation. Such radial movement inward would also compress the cells in the honeycombed hexagonal layer 20 and result in the reduction of the impact forces, as described above.

Figure 4:
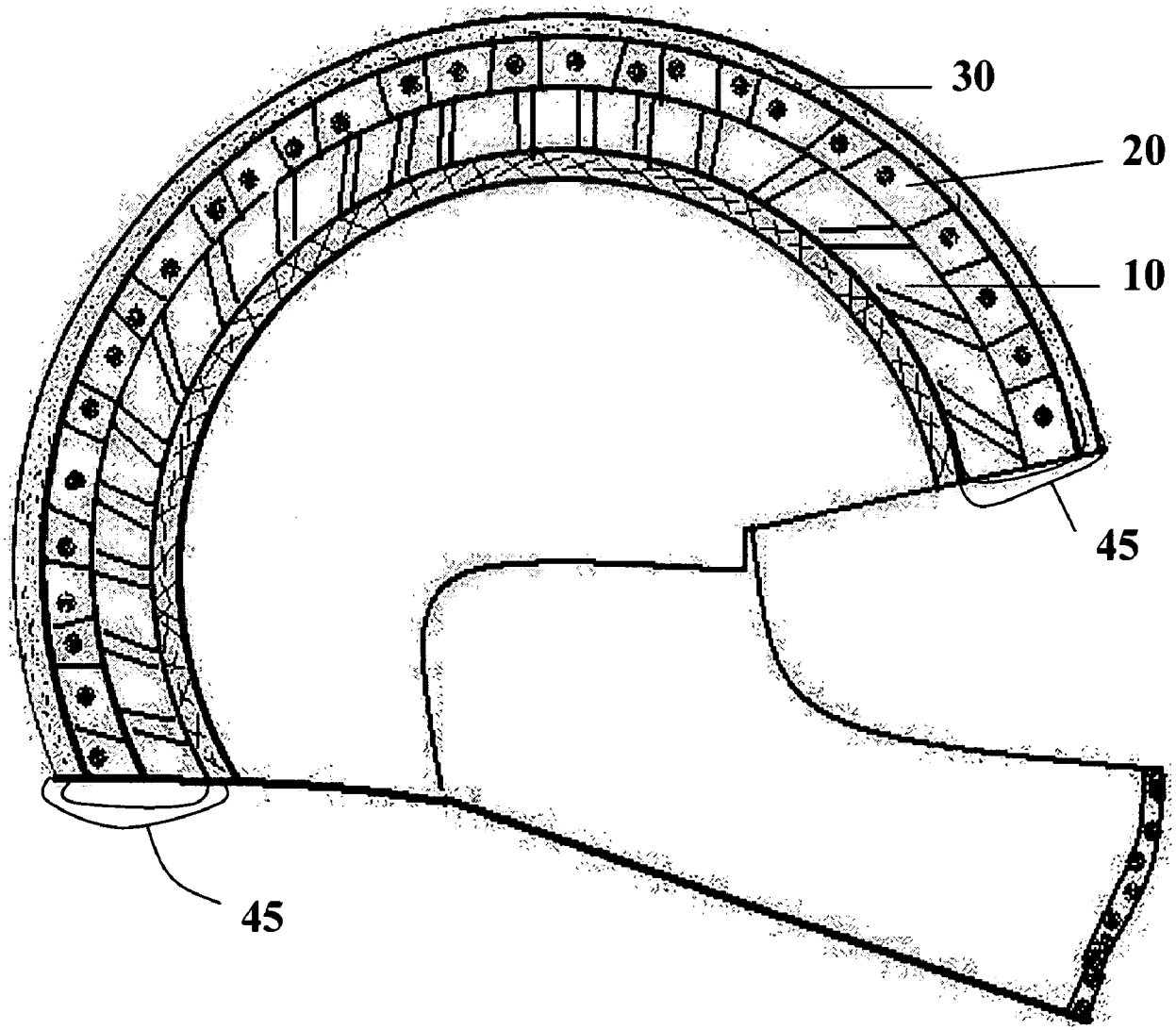
FIG. 4 shows a cross-sectional view of the helmet with attachment strips that bind the outer layers to the hard casing of the helmet.

In this embodiment, the layer 30 may consist of an attachment strip, which binds the lower edges of this outer layer with the hard casing of the helmet, as depicted in FIG. 4. This layer 30 would have sufficient flexibility to move radially or deform elastically while compressing the internal layer 20 and yet be retained in the same structural reference position by virtue of the corresponding attachment strips, 45. The attachment strips may be made of flexible/elastic yet durable polymeric or other material.

In a modification of the preferred embodiment, the outer layer(s) may consist of a third layer made of energy absorbing, uniformly consistent material such as flexible polyurethane foam, which would be directly in contact with the hard casing of the helmet and the above two layers 20 and 30 would be on the outer side of such a layer. This third outer layer would further increase the time of impact as it elastically deforms itself while absorbing the impact forces and thereby further reduces the strength of the impact force.

In another embodiment of the present invention, the outer layer 30 may be made up of an alloy of suitable metals or of composite material. It may include nano-materials or be made using nanotechnology based manufacturing processes. Nanotechnology is a broad term used to describe a variety of techniques to fabricate materials and devices on the nanoscale i.e. at one billionth, or $10^{-9}$ of a meter. It is a highly multidisciplinary field that encompasses several traditional disciplines. More specifically, through the use of nanotechnology or molecular manufacturing, the molecular structure for instance of polymers or individual molecules may be manipulated to yield desired properties such as enhanced strength and durability. Materials thus produced may be used in one or more embodiments of the present invention.

In a modification of the embodiments described above, the outer layer(s) may be manufactured as an integrated, standalone protective layer that could be universally adapted and incorporated onto any existing helmet to transfer the benefits elucidated above.

In the foregoing specification, the invention has been described with reference to an illustrative embodiment thereof. However, it will be evident that various modifications and changes may be made thereto without departing from the broader spirit and scope of the invention. The specification and drawings are, accordingly, to be regarded in an illustrative rather than a restrictive sense. Therefore, it is the object of the appended claims to cover all such modifications and changes as come within the true spirit and scope of the invention.

What is claimed is:

1. A protective headgear assembly that reduces the impact forces by spreading them laterally and uses air to resist and decrease the rate of deceleration of the impact forces, said headgear assembly comprising of:

an energy absorbent layer made of uniformly consistent viscoelastic material in contact with and placed directly on the outside of a rigid shell;

a honeycomb layer with hollow cells and perforated walls for air to flow from one cell to another, in contact with and placed over the visoelastic energy absorbent layer;

an outer protective layer over such honeycomb layer, made of lightweight yet rigid material.

2. A protective headgear assembly of claim 1, where the energy absorbent, viscoelastic layer is made of polyurethane.

3. A protective headgear assembly of claim 1, where the outer protective layer is made of polymers.

4. A protective headgear assembly of claim 1, where the outer protective layer is made of metal or metal alloys.

5. A protective headgear assembly of claim 1, where the outer protective layer is made of composite materials.

6. A protective headgear assembly of claim 1, where the layers are made of nanomaterials or made using nanotechnology.

7. A protective headgear assembly of claim 1, where the layers are modular and each layer can be removed and replaced independent of the other layers.

8. A protective headgear assembly of claim 1, where the three layers are manufactured as an independent external assembly that may be used universally over the rigid shell of helmets.

9. A protective headgear assembly that reduces the impact forces by spreading them laterally and uses air to resist and decrease the rate of deceleration of the impact forces, said headgear comprising of:

a honeycomb layer with hollow cells and perforated walls for air to flow from one cell to another, in contact with and placed directly on the outside of a rigid shell; and a protective layer over such honeycomb layer, made of lightweight yet rigid material.

10. A protective headgear assembly of claim 9, where the outer protective layer is made of polymers.

11. A protective headgear assembly of claim 9, where the outer protective layer is made of metal or metal alloys.

12. A protective headgear assembly of claim 9, where the outer protective layer is made of composite materials.

13. A protective headgear assembly of claim 9, where the layers are made of nanomaterials or made using nanotechnology.

14. A protective headgear assembly of claim 9, where the two layers are manufactured as an independent external assembly that may be used universally over the rigid shell of helmets.

15. A protective headgear assembly that reduces the impact forces by spreading them laterally and uses air to resist and decrease the rate of deceleration of the impact forces, said headgear comprising of:

an energy absorbent layer made of uniformly consistent viscoelastic material, in contact with and placed directly on the outside of a rigid shell; and a protective layer over such honeycomb layer, made of lightweight yet rigid material.

16. A protective headgear assembly of claim 15, where the outer protective layer is made of polymers.

17. A protective headgear assembly of claim 15, where the outer protective layer is made of metal or metal alloys.

18. A protective headgear assembly of claim 15, where the outer protective layer is made of composite materials.

19. A protective headgear assembly of claim 15, where the layers are made of nanomaterials or made using nanotechnology.

20. A protective headgear assembly of claim 15, where the two layers are manufactured as an independent external assembly that may be used universally over the rigid shell of helmets.

* * * * *